US006698267B1

(12) United States Patent
Olsson

(10) Patent No.: US 6,698,267 B1
(45) Date of Patent: Mar. 2, 2004

(54) METHOD AND IMPACT MACHINE FOR FORMING A BODY

(75) Inventor: Håkan Olsson, Karlskoga (SE)

(73) Assignee: Morphic Technologies Aktiebolag, Karlskoga (SE)

( * ) Notice: Subject to any disclaimer, the term of this patent is extended or adjusted under 35 U.S.C. 154(b) by 0 days.

(21) Appl. No.: 09/890,885

(22) PCT Filed: Apr. 26, 2000

(86) PCT No.: PCT/SE01/00896

§ 371 (c)(1),
(2), (4) Date: Feb. 6, 2002

(87) PCT Pub. No.: WO01/83135

PCT Pub. Date: Nov. 8, 2001

(30) Foreign Application Priority Data

| | | |
|---|---|---|
| Apr. 28, 2000 | (SE) | 0001558 |
| Apr. 28, 2000 | (SE) | 00015594 |
| May 31, 2000 | (SE) | 00020305 |
| Dec. 11, 2000 | (SE) | 00045542 |
| Jan. 12, 2001 | (SE) | 01001064 |

(51) Int. Cl.[7] ..... B21J 7/34; B21J 7/28
(52) U.S. Cl. ..... 72/355.6; 72/355.4; 72/407
(58) Field of Search ..... 72/407, 453.01, 72/355.6, 355.4, 354.6

(56) References Cited

U.S. PATENT DOCUMENTS

| | | | | |
|---|---|---|---|---|
| 3,135,140 A | * | 6/1964 | Ottestad | 100/269.14 |
| 3,271,991 A | * | 9/1966 | Monahan | 72/407 |
| 3,422,658 A | * | 1/1969 | Michelson | 72/407 |
| 3,822,579 A | | 7/1974 | Kononenko et al. | 72/407 |
| 4,069,700 A | * | 1/1978 | Bocharov et al. | 72/407 |
| 4,191,044 A | * | 3/1980 | Grigorenko et al. | 72/355.6 |
| 4,191,045 A | * | 3/1980 | Stepantsov et al. | 72/407 |
| 4,408,975 A | | 10/1983 | Hack | 425/231 |
| 4,918,967 A | * | 4/1990 | Ishinaga | 72/355.6 |
| 4,918,970 A | * | 4/1990 | Ishinaga | 72/355.6 |
| 4,977,804 A | | 12/1990 | Naito | 83/76.7 |
| 5,086,633 A | * | 2/1992 | Meyerle | 72/20.5 |
| 5,326,242 A | | 7/1994 | Katagiri et al. | 425/78 |
| 5,934,165 A | | 8/1999 | Chatham | 83/588 |

* cited by examiner

*Primary Examiner*—Daniel C. Crane
(74) *Attorney, Agent, or Firm*—Michael D. Bednarek; Shaw Pittman LLP

(57) ABSTRACT

A method of forming a body of a formable working material in an impact machine, which comprises an upper impact unit (29 with an upper ram (14), an upper punch (17), a lower impact unit (3) with a lower ram (24), a lower punch (27), and mould cavity for the working material between the punches when the punches are brought towards one another, is characterized in that downwards movable masses, which comprise at least the mass of the upper ram and the mass of the upper punch, and upwards movable masses, which include at least the mass of the lower ram and the mass of the lower punch, are caused to move towards one another and towards the working material in the mould cavity, that the masses which move downwards, including the upper punch (17) obtain a downwards directed velocity ($v_1$) and those masses which move upwards, including the lower punch (27), obtain an upwards directed velocity ($v_2$), wherein the movable parts have such masses and the velocities are so high that the momentums of the downwards movable masses and the upwards movable masses become essentially equally large, i.e. so that the following condition applies.

$$m_1 \times v_1 \approx m_2 \times v_2$$

where $m_1$ is the total mass of the downwards movable masses during the stroke, and $m_2$ is the total mass of the upwards movable masses during the stroke.

19 Claims, 5 Drawing Sheets

METHOD AND IMPACT MACHINE FOR FORMING A BODY

TECHNICAL FIELD

The invention relates to a method of forming a body of a formable working material in an impact machine, which comprises an upper impact unit with an upper ram, an upper punch, a lower impact unit with a lower ram, a lower punch, and a mould cavity for the working material between the punches when the punches are brought towards one another. The invention also relates to an impact machine for the carrying out of the method.

BACKGROUND ART

Impact machines for working by the employment of high kinetic energy are machines for working in the first place metal, such as cutting, punching, and plastic forming of powder-components, powder compaction, and similar operations, in which the speed of a ram, which may consist of a press piston, may be essentially higher than in conventional presses. Also polymeric and ceramic working materials can be conceived, as well as various composites of metals, polymers and ceramic materials. The working principle is based on the development of a very high kinetic energy of short duration instead of a high static press force of long duration. The dynamic forces of short duration which are generated at the ram impact and which in impact machines of prior art are conveyed around in the system via stand and foundation may be several thousand times larger than in conventional presses and imply that considerable amounts of energy are lost in stands and foundations instead of being used for effective work at an optimal way. In order to be able to absorb large force pulses, impact machines of prior art are equipped with very strong and heavy stands and foundations according to principles which are common in connection with conventional presses. Nevertheless the dynamic, shock type force pulses that are developed in impact machines are not damped in such heavy, conventional systems. The stress on all joints therefore become very large, as well as on sensitive components, e.g. electronic components for controlling those hydraulic valves which usually form parts of impact machines, which may cause a great risk of failure. Large, unwieldy stands also give rise to problems in connection with service, change of tool unit or of tool insets in the tool unit, changing the height of the impact unit above the tool unit, etc.

BRIEF DISCLOSURE OF THE INVENTION

It is the purpose of the invention to address the above complex of problems. More particularly, the invention aims at achieving in the first place the following advantages:

- to provide that the kinetic energy of rams can be used essentially for effective work in connection with the working of a working material instead of being lost in tools and auxiliary equipment, such as stand and foundation, which in turn can create improved possibilities to work and/or to form materials which previously have not been possible to be worked and/or formed to a desired degree,
- to counteract shock waves from the impact via the machine stand, which in turn makes it possible to use a substantially lighter stand, and to eliminate heavy bases, which according to prior art have had the purpose of absorbing shock waves,

- to reduce the total mass of the machine in comparison with known comparable impact machines, including reducing the sizes of the impact units, at the same time as lower striking velocities can be employed for the achievement of desired working, and
- to make it possible to compact metal powders or other formable powder, such as ceramic powders or composite powders consisting mainly of metal, ceramic and/or polymeric powders, to a higher and more even density than what has been possible by means of prior art because of losses of energy in tools and auxiliary equipment.

The characteristic feature of the invention is that a body is formed of a formable working material in an impact machine comprising an upper impact unit with an upper ram, an upper punch, a lower impact unit with a lower ram, a lower punch, and a mould cavity for the working material, wherein downwards movable masses, which comprise at least the mass of the upper ram and the mass of the upper punch, and upwards movable masses, which comprise at least the mass of the lower ram and the mass of the lower punch, are caused to be moved towards one another and towards the working material in the mould cavity; that the masses which move downwards, including the upper punch, obtain a downwards directed velocity $v_1$, and the masses which move upwards, including the lower punch, obtain an upwards directed velocity $V_2$, wherein the movable parts have such masses and the velocities are so high that the momentum of the downwards movable masses and the upwards movable masses become essentially equal, i.e. such that the following condition applies:

$$m_1 \times v_1 \cong m_2 \times v_2$$

where $m_1$ is the total mass of the masses moving downwards, and $m_2$ is the total mass of the masses moving upwards plus the impact;

that the kinetic energies of the movable masses, i.e.

$$\frac{m_1 v_1^2}{2}, \text{ and } \frac{m_2 v_2^2}{2},$$

respectively, are essentially transferred to the working material in the mould cavity and are so great that the working material is plasticized and flows out to fill all parts of the mould cavity, when the punches are maximally brought together, for the formation of said body with desired shape.

According to a preferred method of carrying out the method, the body is formed of the formable working material in an impact machine which also comprises a central unit, said central unit including a die having a through hole which together with the upper punch and the lower punch form said mould cavity, said die being essentially stationary during the impact operation.

However, one can also conceive, according to an alternative embodiment, particularly for forming comparatively thin objects, that the machine has no central unit with a die, wherein the mould cavity is formed between the punches without any surrounding die, i.e. therein that one or both punches, preferably at least the lower one, is engraved, i.e. is embossed.

Prior to the impact, the upper punch and the lower punch preferably are pressed from above and from below, respectively, by a downwards directed force and by an upwards directed force, respectively, causing a static pressure from above and from below, respectively.

What is particularly characteristic according to an aspect of the invention, is that the upper and lower impact units can be raised and lowered in a controlled way for the setting of predetermined lengths of the upper ram and of the lower ram, respectively, prior to the forming operation in the case that the machine comprises an essentially stationary, central unit, wherein, according to this aspect of the invention, the upper and lower impact unit may be vertically adjustable in a controlled way relative to said central, essentially stationary unit.

Because of the short duration of the pressure pulse, when the material in the mould cavity is worked in a symmetrical way due to combined action by momentums from two directions, the risk that the high pressure will deform the punches and/or the die tool is reduced when the machine comprises a die, because of the inertia of the mass of the tool material. This allows for higher pressure in the mould cavity than what is possible according to prior art including forming by employing high kinetic energy, wherein the possibility to plasticize the working material in the mould cavity is improved. Because of the rapid material working, at least according to a conceived embodiment of the method and of the machine, and because of very short movements of the punches, also considerably less friction between the tool and working material will arise, and, in the case that the working material consists of powder, also less friction between the powder grains, which makes a considerably improved yield in the forming and the consolidation process possible, in other words that more energy can be brought to act on the working material. In an uncontrolled process there is a great risk that the tool will be damaged because of large friction forces.

It is thus a characteristic feature of the invention that a very high forming pressure is built up symmetrically from two directions and is allowed to act on the material that shall be shaped or consolidated with minimal losses due to friction, mass forces, and propagation of high frequent waves caused by impact initiated resonances in tool details and in surrounding machine, including the machine stand. Thus a very high forming pressure can be allowed to act in the tool chamber/mould cavity without breaking down the tool parts, because of an extremely short duration of the forming pulse and a great inertia of included tool parts.

A conceivable embodiment of the impact machine is characterized in that the upper impact unit comprises an upper impact body, that the lower impact unit comprises a lower impact body, that the upper punch and the lower punch are provided to be brought into contact with the working material in the mould cavity in the die prior to the forming operation, that the upper impact body and the lower impact body have, or are provided to be brought into direct or indirect mechanical contact with the upper punch and with the lower punch, respectively, at the latest in the functional positions of the impact bodies prior to the forming operation, that the length of the strokes of the rams correspond to the distance from the upper ram to the lower impact body when the lower impact body is in its functional position and the distance from the lower ram to the lower impact body when the lower impact body is in its functional position, respectively.

Said elevator devices for raising and for lowering the upper and lower impact units are suitably hydraulically working devices, wherein they can contribute to dampen shock waves which possibly may arise in connection with the forming operation, and may include at least two upper hydraulic lifting cylinders with vertical upper piston rods, which are included in an upper stand unit and carry an upper carrier for the upper impact unit; and at least two lower hydraulic lifting cylinders with vertical lower piston rods, which are included in a lower stand unit provided to carry a lower carrier for the lower impact unit. The piston rods form columns in the stand, which can be made very slender. Possibly, the number of such columns/piston rods with their sets of hydraulic cylinders may be increased to be more than two, however, suitably not more than four, in order to enhance the stability of the machine. Alternatively special guides may be provided to increase the stability, particularly the lateral stability. The hydraulic cylinders may be either stationary and fixedly united with the base or foundation, wherein the piston rods/columns are vertically adjustable relative to the base, or stationary. In the latter case, the piston rods suitably are designed as through piston rods in hydraulic cylinders which are mechanically connected with said carriers, which carry the impact units, as according to the principle described in the Swedish patent application No. 0001560-2 by the same applicant, the disclosure of said patent application being incorporated in the present patent application by reference.

When forming solid blanks, the blank should have a smaller extension in the radial direction than the tool cavity in order to make it possible to plasticize the blank before it contacts the side walls of the mould cavity. If an annular product shall be manufactured from a solid blank, the blank should have the shape of a ring, the outer diameter of which is smaller than the diameter of the tool cavity, and the inner diameter of which is larger than the diameter of the mandrel which in that case is provided in the centre of the tool, for the purpose of eliminating initial friction against the side wall of the mould cavity and against the mandrel.

In the foregoing description of the background art it is mentioned that impact machines employing high kinetic energy for working are machines in which the velocity of a ram, which can consist of a piston, can be substantially higher than in conventional presses. As a matter of fact this technique is often referred to as high velocity forming because high velocities of the impact members in impact machines generally have been considered to be a prerequisite for the achievement of intended results in terms of forming work. High velocities of the movable impact members, however, may imply a complication when working with those impact machines which are described in said Swedish patent applications, which machines work according to the counter striking pinciple, i.e. work with impact members which move towards one another during the striking/impact operation or with a lower, upwards movable anvil, which moves upwards, at the same time as upper impact members move downwards towards the movable anvil. The complication lies in the fact that the movements of the units which are movable towards one another must be synchronized and coordinated with great accuracy in terms of velocity (impulse) and position in order that the stroke shall be performed simultaneously with correct impulse of the masses which move towards one another, something which becomes increasingly difficult the higher the velocities of the moving parts are.

An aspect of the invention is based on the consideration that the velocities of the movable units in the impact machines, which move against one another during the impact operation, need not at all be as large as has been considered necessary because of what is taught by prior art. Nor should the kinetic energies need to be correspondingly high, i.e. lower velocity shall not necessarily need to be compensated by correspondingly larger movable masses. With the same masses, according to this aspect of the invention, the velocity thus can be reduced from about of 5 to 10 meters per sec. of said rams to the order of 1 meter per sec., or more generally 0.5–2 meters per sec.

The lower velocities thus improve the possibility to synchronize the movements of the movable units during the impact operation. Even though the velocities are radically reduced, the forming work nevertheless can be perfect, whether the working material is a powder or a solid body. Without binding the invention to any specific theory, it can be assumed that this is due to the good synchronization of the counter directed movements, which in turn has the result that the kinetic energy of the movable masses essentially can be used as effective forming work with small losses of energy to the machine foundation and stand.

Another favourable effect with the lower velocities of the movements that are movable towards one another, is that the ram travels can be shortened. This makes it possible to design the impact devices/the rams and the punches to form integrated units, as above mentioned. The punches in this case may be inserted into the upper and lower openings, respectively, of the die in the starting position for an impact operation, even if the punches are integrated with the impact devices/rams or corresponding, wherein the ram travels, i.e. the acceleration lengths, will be shorter than the axial length of the mould cavity of the die.

It shall thus be understood that the expressions high kinetic energy or very high kinetic energy are relative conceptions and shall be interpreted to mean adequate kinetic energy for the achievement of the effect in terms of forming work, which has been mentioned in the foregoing and which will be described more in detail in the following, detailed description of the invention.

Further characteristic features and aspects of the invention as well as advantages will be apparent from the appending patent claims and from the following description of an embodiment.

BRIEF DESCRIPTION OF DRAWINGS

In the following description of a preferred embodiment reference will be made to the accompanying drawings, in which.

DESCRIPTION OF PREFERRED EMBODIMENT

Figure 1:
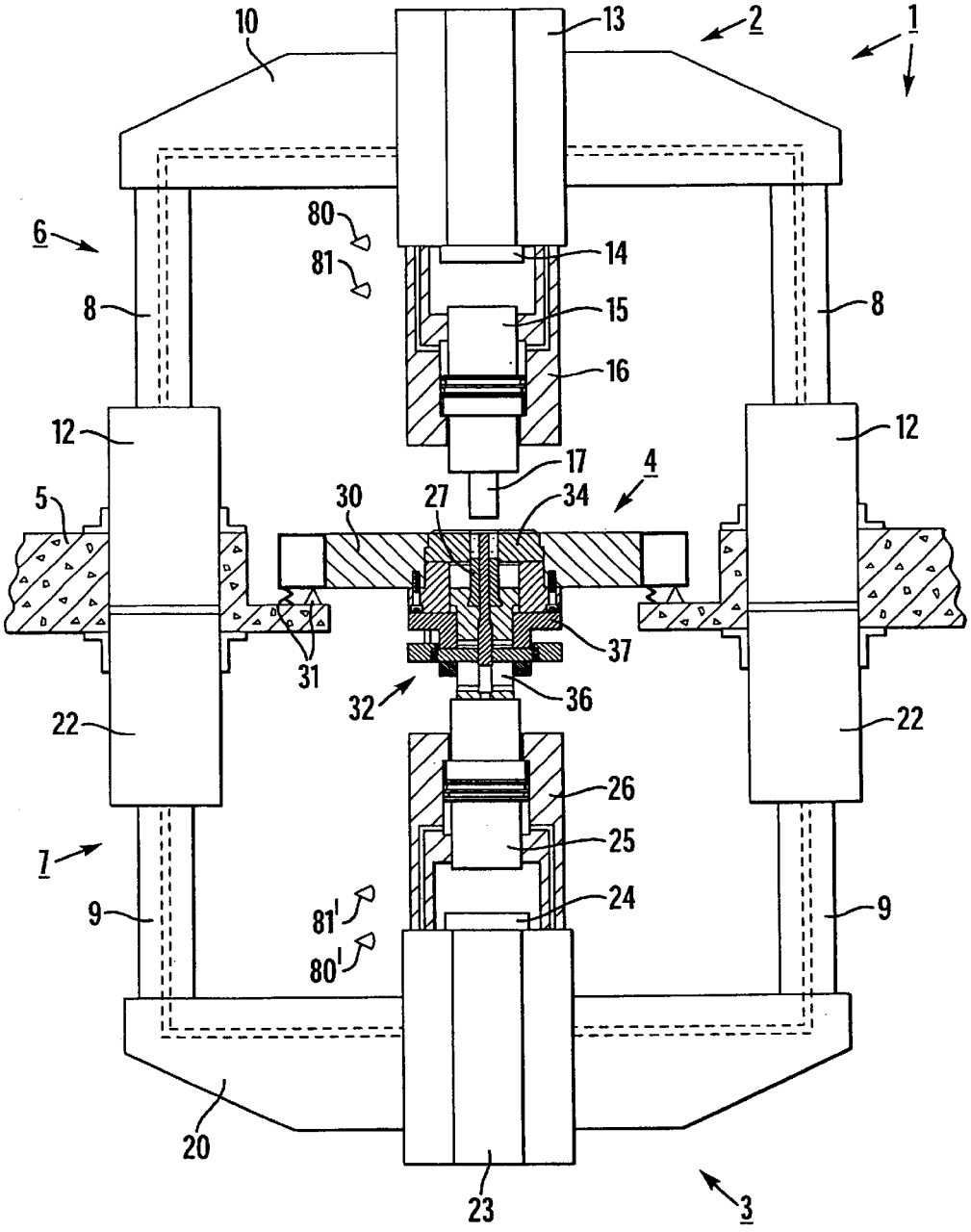
FIG. 1 is a side view, partly schematically, of the impact machine according to the preferred embodiment of the invention.

With reference first to FIG. 1, an impact machine is generally designated 1. Its main parts consist of an upper impact unit 2, a lower impact unit 3, a central unit 4, an upper stand 6 consisting of two upper rods 8, which consist of a pair of piston rods, and a lower stand 7 consisting of a pair of lower rods 9, which also consist of a pair of piston rods. A foundation or base is designated 5.

The upper impact unit 2 comprises a yoke 10 on the piston rods 8, which yoke can be raised and lowered by means of two upper, hydraulic lifting cylinders 12, which are united with the base 5, the hydraulic chambers of which are filled with and drained of hydraulic fluid via hydraulic conduits which extend through the piston rods 8 and the yoke from and to a pressure source and a tank, respectively. The yoke 10 carries an upper hydraulic impact cylinder 13, which is connected with the yoke, said impact cylinder containing an upper ram in the form of an impact piston 14. An upper impact body is designated 15. The impact body is movable in an upper impact body cylinder 16. An upper punch 17 is replaceably united with the impact body 15. The upper impact body cylinder 16 is fixedly united with the upper impact cylinder 13.

The lower impact unit 3 comprises a lower yoke 20, which is suspended under the rods 9, which consist of two piston rods, which can be raised and lowered by means of two lower, hydraulic lifting cylinders 12, which also are united with the base 5 and which can be filled with and drained of hydraulic fluid via hydraulic conduits through the piston rods 9 and the yoke 20 from and to a pressure source and a tank, respectively. The yoke 20 carries a lower, hydraulic impact cylinder 23 which is united with the yoke and contains a lower ram in the form of an impact piston 24. A lower impact body is designated 25. The lower impact body is movable in a lower impact body cylinder 26.

The central unit 4 comprises a table 30, which may be movable in the horizontal plane but is in principle stationary in the vertical direction, although means are provided to allow a certain flexibility in the vertical direction. The table 30 for example can consist of a turn-table, wherein motion members are provided to turn the table between different processing-stations, or consist of a shuttle which can be moved in a linear direction between two or more processing-stations. The devices for the movements in the horizontal plane and for allowing the flexibility in the vertical direction have been shown only schematically in FIG. 1 and are designated 31. The table 30 contains and carries a number of identically equal, functional units 32. Such a functional unit is shown in detail in FIG. 3 and FIG. 4 and more schematically in FIG. 1. The main parts of the functional unit 32 shown in FIG. 1 comprise a lower, tubular punch 27, a die 34, a lower punch holder 36, which is slideably movable in a punch holder guide 37, and a mandrel 35.

Figure 3:
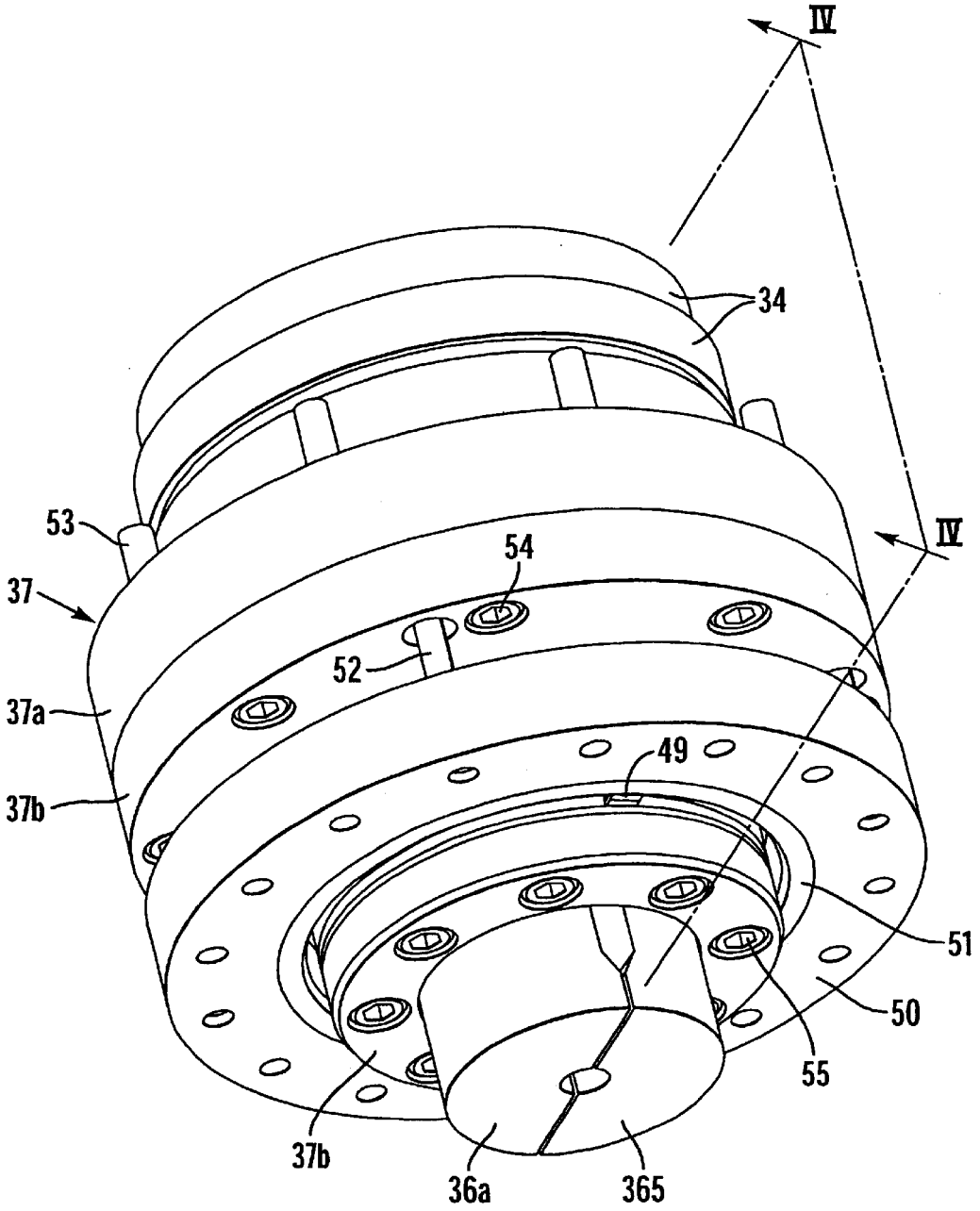
FIG. 3 is a perspective view of the central functional unit included in the machine.
Figure 4:
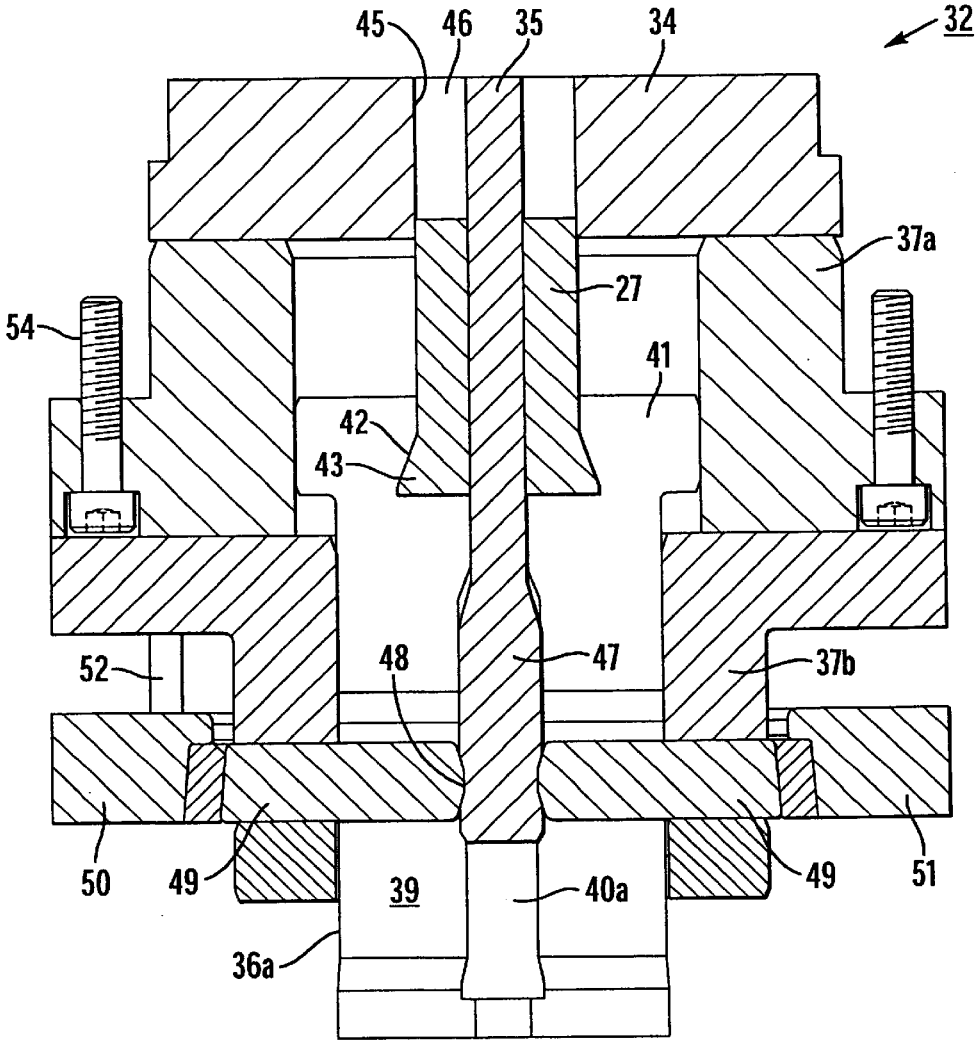
FIG. 4 shows the functional unit in cross section along line IV—IV in FIG. 3.

The lower punch holder 36, FIG. 3 and FIG. 4, consists of two identical halves 36*a* and 36*b*, which are pressed to nearly contact one another along a vertical parting line, namely in the region of the upper part of the punch holder extending almost half the length of the punch holder, and in a lower part having a short vertical extension. Between these upper and lower parts, the two halves of the punch holder are milled-out to form a vertical through slot having a significant extension in the vertical direction. There is also a vertical, central recess in each punch holder half 36*a* and 36*b*, such as the recess 40*a* in the punch holder half 36*a*. The opposite recess 40*b* in the punch holder half 36*b* is not shown in the drawings. In combination the slot 39 and the recesses 40*a*/40*b* allow the punch holder 36 to move in the vertical direction relative to the mandrel 35. In its upper part each punch holder half 36*a* and 36*b* has a flange 41 turned outwards and a central recess 42, which widens in its bottom portion to accommodate a correspondingly designed head 43 in the bottom end of the lower punch 27. Together the two punch holder halves 36*a* and 36*b* retain the lower punch 27.

The illustrated example concerns manufacturing of products having a through hole, such as gears. The lower punch 27 therefore is tubular and the mandrel 35 extends through the lower punch. In the die 34 there is a through cylindrical hole 45, the walls of which correspond to the outer shape of the desired product, i.e. a gear. The shape of the hole 45 also corresponds with the outer shape of the lower punch 27 above the head 43 and of the upper punch 17, which like the lower punch 27 has the shape of a tubular sleeve.

The mandrel 35 has an elongated, cylindrical upper portion, which extends through the lower punch and up into the mould cavity 46, which is defined by the hole 45 in the die 34 between the two punches 17 and 27. In its lower part, the mandrel has a thicker portion, here denominated grip portion 47, which has a circumferential concavity or groove 48.

The punch holder guide 37 consists of an upper member 37*a* and a lower member 37*b*. The insides of the two parts 37*a* and 37*b* are cylindrical. The upper part 37*a* has a larger diameter than the lower part 37*b*. The parts 37*a* and 37*b* function as guides for the flange portion 41 and for the main portion, respectively, of the lower punch holder 36, said portions having a correspondingly cylindrical outer shape. The lower part 37*b* in combination with the flange portion 41 of the lower punch holder also works as a retainer of the lower punch holder. The two parts 37*a* and 37*b* are connected with one-another through screw joints 55.

In the lower portion of the lower part 37*b* of the punch holder guide there are two opposite recesses for two opposite wedges 49, which are forced into the groove 48 of the grip portion 47 of the mandrel 35. The force is obtained by means of a locking ring 50 and a bushing ring 51 of polyurethane or other material having some flexibility. The wedges 49 allow some elastic deflection because of friction forces which may be exerted on the mandrel 35 during the working strokes of the machine. A number of guide pins 52 extend from the locking ring 50 up through the punch holder guide 37 for maintaining the locking ring in its rotational position relative to the punch holder guide when the locking ring 50 has been released and is moved axially for pulling out the wedges 49 in connection with the exchange of the mandrel and/or of the lower punch 27. A number of upper guide pins 53 are also provided, which extend upwards from the punch holder guide 37 and further up in the table 30. Finally, screws 54 are also provided for mounting the entire unit 32 in the table 30 from beneath.

The upper impact body 15 consists of a through cylindrical piston rod 60 with an annular flange 61. The piston rod 60 can slide in an opening in an upper end wall 62 of the upper impact body cylinder 16, where a seal is provided. In a lower end wall 63 there is a wider opening 64, through which the cylindrical piston rod 60 of the impact body 15 can move without any sealing. The flange 61 has a diameter which is slightly smaller than the inner diameter of the impact body cylinder 16, i.e. the flange 61 does not sealingly contact the inside of the cylinder. Above the flange 61 there is a movable ring 65, which can move relative to the piston rod 60, said movable ring sealing against the inside of the impact body cylinder 16, either directly or via one or more sealing rings. Also the inside of the movable ring 65 is sealed against the piston rod 60, either through a direct sealed contact or via any not shown sealing ring.

Above the movable ring 65 there is a hydraulic chamber 66, which is connected to a pressure source of hydraulic fluid via a hydraulic conduit 67, in which there is a non-return valve 68 and a not shown pressure reducing valve, and to tank or accumulator via a hydraulic conduit 69, in which there is a not shown pressure restricting valve.

Figure 2A:
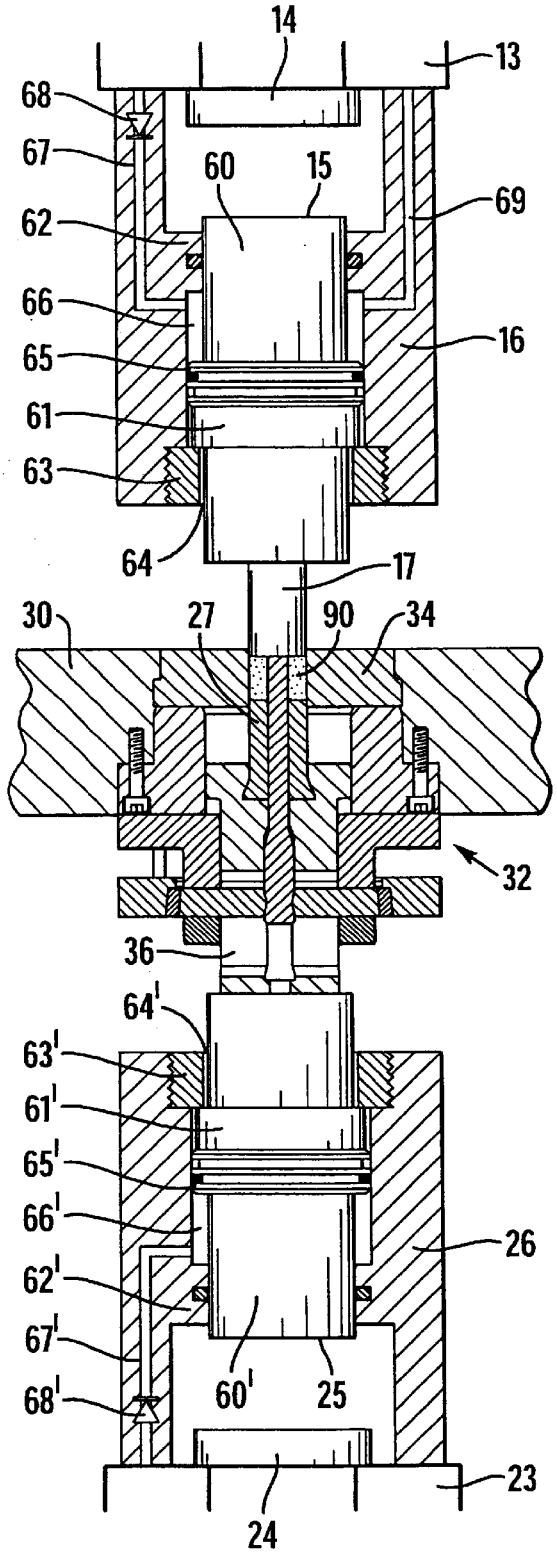
FIGS. 2A and 2B show parts of the impact units and of a central functional unit, which is stationary during the striking operation, during two different stages before the working stroke/forming operation.
Figure 2B:
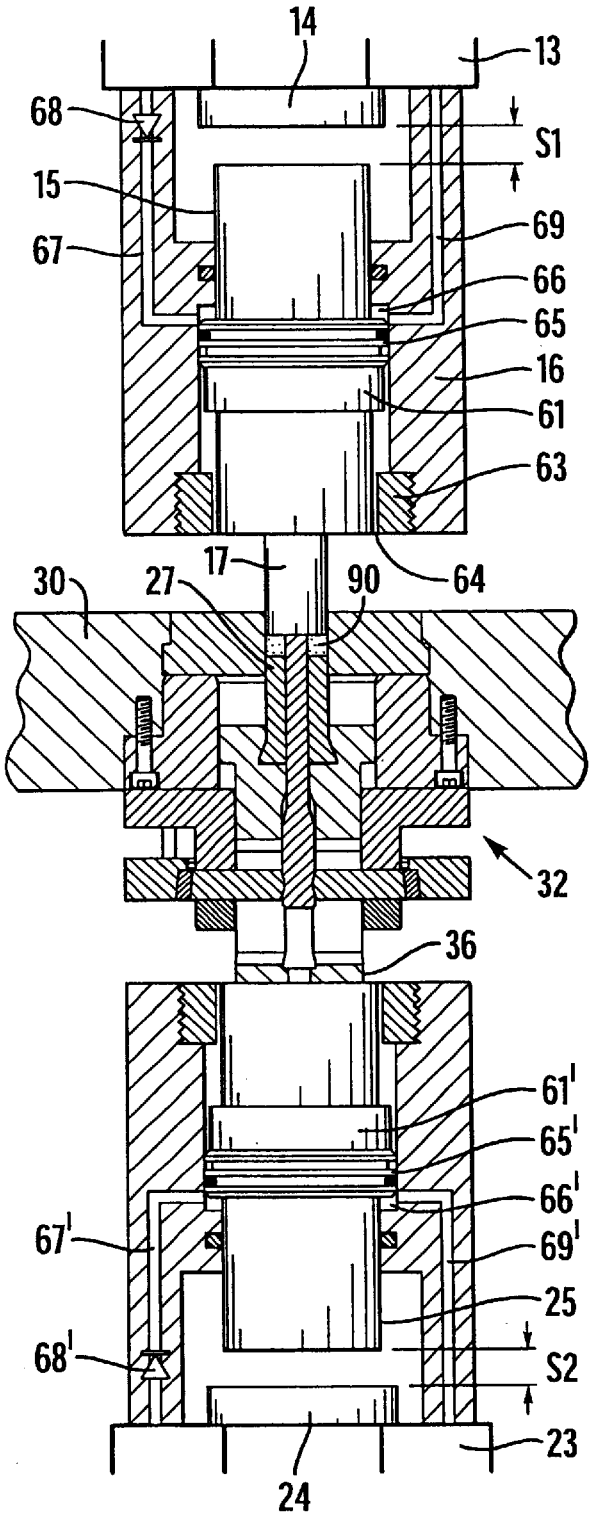

The lower impact body 25 and its impact body cylinder 26 are designed in identically the same way as the upper impact body 15 and the impact body cylinder 16, respectively, with the exception of the lower punch 27 which is not directly fastened to the impact body, as is the case with the upper punch 17 in the upper impact body 15. In FIGS. 2A and 2B the various details of the impact body 25 and the impact body cylinder 26 have the same reference numerals as for the details of the upper impact body and the impact body cylinder 16 with the addition. Therefore any further description of these details are not made here, but instead is referred to the above description of the upper impact body 15 and its impact body cylinder 16. As far as the terminology is concerned, however, shall be mentioned that the end walls 62' and 63' of the lower impact cylinder 26 are denominated lower end wall and upper end wall, respectively.

The equipment also includes control and operating devices for the described, movable units, including position sensors 80, 80' for the impact cylinders 13 and 23, respectively, and hence also for the rams 13 and 24, respectively, and position sensors 81 and 81' for the impact bodies 15 and 25, respectively. Said sensors are connected to and transmit information about the position of said units to a central control unit, which comprises computers and auxiliary devices, which are not described here.

The described equipment works in the following way. In a foregoing operation the space 46 in the die hole 45, FIG. 4, has been filled with working material 90 around the mandrel 35 The working material 90 can consist of for example a ring of metal, a polymeric material or a composite material, which can include ceramic or other formable material, but in the example it is presumed that the working material consists of a metal powder or possibly a combination of metal and ceramic powders. To start with, the lower yoke 20 is raised by means of the lower lifting cylinders 22 and the piston rods 9, bringing with them the lower impact body cylinder 23 and its impact body 25 until the impact body 25 has been brought into contact with the underside of the lower punch holder 36, FIG. 1 and FIG. 2A. Then the upper yoke 10 is lowered by means of the upper lifting cylinders 12 and the piston rods 8, bringing with them the upper impact body cylinder 16 and its impact body 15 so far that the upper, tubular punch 17 is brought down to contact the metal powder 90 in the mould cavity 46 and begins to compress the powder until the pressure in the hydraulic chamber 66 reaches a certain, predetermined value. The movement is stopped and the position is maintained. The lower punch 27 in this stage is in the position shown in FIG. 2A, positioned by the lower impact unit 7, and establishes the holding-up force.

The yoke 20 now starts moving upwards by means of the lifting cylinders 22, wherein the lower punch is pressed upwards against the powder 90. The movement continues until the pressure in the hydraulic chamber 66' has reached a certain, predetermined value. This pressure has also then been transmitted to the hydraulic chamber 66 of the upper impact unit via the powder 90. The powder therein has been pre-compacted and centered in the mould cavity 46 in the die 34. The impact bodies 15/25, the hydraulic cylinders 16/26 and the punches 17/27 now are in the positions shown in FIG. 2A The next operation aims at setting the stroke lengths S1 and S2 of the rams 14 and 24, i.e. the distance between the upper ram 14 and the upper impact body 15, and between the lower ram 24 and the lower impact body 25, respectively, before the striking operation. The setting can be carried out simultaneously for the upper 2 and the lower 3 impact unit by pressing the yokes 10 and 20 further downwards and upwards, respectively, by means of the hydraulic cylinders 12 and 22, respectively. The pre-compacted powder 90 herein exerts a counter-pressure on the punches 17 and 27, wherein the pressure in the hydraulic chambers 66 and 66' is increased further. The overpressure is relieved through the hydraulic conduits 69 and 69'. The punches 17 and 27 therefore will remain in their positions, while the impact pistons/rams 14 and 24 approach the impact bodies 15 and 25, until their correct stroke lengths S1 and S2, FIG. 2B, are achieved, which is achieved by the upper and lower position sensors 80, 81 and 80', 81', respectively. The pressure difference between the lower and upper hydraulic chambers 66' and 66 herein is provided to be so small that it will not have any influence on the stroke lengths to any non-negligible degree.

When the intended stroke lengths S1 and S2 thus have been achieved, the flange 61 and the ring 65 of the upper impact body 15 are in an upper position, and the flange 61' and the ring 65' of the lower impact body 25 are in an upper position and a lower position in the hydraulic cylinders 16 and 26, respectively, FIG. 2B. The impact machine is now ready to consolidate the powder 90 for forming the desired article through a single, simultaneous stroke by the two rams 14 and 24.

The distances S1 and S2 are the travels of acceleration of the rams/impact piston 14 and 24, and are chosen under consideration of in the first place the masses of the rams and the impact bodies such that the total mass $m_1$ of the upper ram 14, the upper impact body 15 and the upper punch 17 will obtain a downwards directed velocity $v_1$ when the ram 14 has hit the impact body 15, and the total mass $m_2$ of the lower ram 14, the lower impact body 25, the lower punch 27 and the lower punch holder 36 obtains an upwards directed velocity $v_2$ when the ram has hit the impact body, wherein the masses and the velocities are so large that the momentums (the quantities of motion) of the masses that move downwards and upwards, respectively, are essentially equal, i.e. so that the following condition applies:

$$m_1 \times v_1 \approx m_2 \times v_2$$

The upper ram 14, which according to the embodiment has a substantially larger mass than the upper impact body 15 (also the opposite condition is conceivable as well as that the ram and the impact body have equally large masses), thus strikes with a required velocity, at the same time as the lower ram 24, which according to the embodiment also has a much larger mass than the lower impact body 25 (although also in this case the masses may be equally large or that the opposite condition applies) strikes with a required velocity on the lower impact body 25. The kinetic energies of the moving masses, which are very high, are transferred via the upper punch 17 and the lower punch 27 to the powder 90. The rams 14 and 24 perform only one stroke, but the kinetic energies which essentially are transferred to the metal powder 90 in the mould cavity 46 are so large that the powder is plasticized, wherein it will flow out and fill the mould cavity and in a millisecond or so form a consolidated body with desired shape. The pressure pulse that arises in the mould cavity because of the single stroke of the rams against the impact body has a duration which is shorter than 0.001 second but has a magnitude lying in the range 1–10 GPa, typically in the range 1.5–5 GPa. Because of the high pressure and the plasticizing caused by the high pressure, probably also the friction between the working material/the powder and the walls of the mould cavity is reduced, as well as between the powder grains, which contributes to, or is a prerequisite for the ability of the material to flow out and to fill all parts of the mould cavity. At the impact the mandrel 35 is essentially stationary relative to the die 34, as well as during the pre-compaction of the powder which is possible because the lower punch holder is movable relative to the mandrel, which is held by the wedges 49 in the slot 39 in the punch holder.

At the same time as the desired body is formed almost instantaneously therein that masses of essentially equally large momentums are stricken from opposite direction against the working material, the development of shock waves of such magnitude that could damage components of the machine is counteracted, and it is essentially prevented that kinetic energy of the movable masses are conveyed to and are lost in the machine and the foundation. This is due to the fact that the shock waves that might arise will be oppositely directed, wherefore they to a significant degree will eliminate one another. Further the hydraulic fluid in the lifting cylinders 12 and 22 dampen the shock waves which possibly remain and which propagate via the machine stand to the base 5. These conditions make it possible to design the entire machine as light as is illustrated by the example.

When the rams at a high velocity strike the impact bodies 15 and 25, respectively, the cylindrical piston rods 60 and 60' of the impact bodies move freely relative to the movable rings 65 and 65', respectively, said rings during the stroke remaining essentially in those positions they had adopted prior to the stroke, FIG. 2B. A small play is created between on one hand the retained movable rings 65 and 65' and on the other hand the flanges 61 and 61', corresponding to the final compaction of the powder 90 in vertical direction at the impact.

As soon as the rams 14 and 24 have performed their simultaneous strokes, they are returned to their starting positions in the upper 13 and the lower impact cylinder 23, respectively. The yokes 10 and 20 are returned to their starting positions by means of the lifting cyinders 12 and 22. Pressure fluid is led to the two hydraulic chambers 66 and 66', so that the movable rings 65 and 65' are pressed downwards and upwards, respectively, to contact the flanges 61 and 61, whereafter the movable rings press the entire impact bodies 15 and 25 to their starting positions, in which the flanges 61 and 61' contact the end wall 63 and 63', respectively. The working cycle therein has been completed, whereafter the functional unit 32 can be moved to a new station, in which the formed product is pushed out from the mould cavity 46.

What is claimed is:

1. A method of forming a body of a formable working material in an impact machine, the impact machine comprising an upper impact unit with an upper ram, an upper punch, a lower impact unit with a lower ram, a lower punch, an upper impact body, a lower impact body, and a mould cavity for the working material between the punches when the punches are brought towards one another, the method comprising:

moving downwards movable masses and upwards movable masses towards one another, the downward movable masses obtaining a downwards directed velocity and the upwards movable masses obtaining an upwards directed velocity, wherein downwards movable masses comprise at least the mass of the upper ram and the mass of the upper punch, wherein the upwards movable masses comprise at least the masse of the lower ram and the mass of the lower punch, wherein the upper punch and the lower punch are pressed at a static pressure from above and below, respectively, against the working material in the mould cavity prior to the impact by a downwards directed force exerted on the upper impact body and by an upwards directed force exerted on the lower impact body, respectively, wherein the movable parts have such masses and velocities so that the momentums of the downwards movable masses and the momentums of the upwards movable masses become essentially equal and the following condition applies:

$$m_1 \times v_1 \approx m_2 \times v_2$$

where $m_1$ is the total mass of the downwards movable masses and $m_2$ is the total mass of the upwards movable masses at impact, and wherein the kinetic energies of the movable masses, defined as $(m_1 v_1^2)/2$ and $(m_2 v_2^2)/2$, are essentially transferred to the working material in the mould cavity and are of a magnitude such that the working material is plasticized and flows out to fill all parts of the mould cavity when the punches are maximally brought together for the formation of said body with desired shape.

2. The method of claim 1, the impact machine further comprising a central unit with a die having a through hole which together with the upper punch and lower punch defines the mould cavity, wherein the die is essentially stationary during the impact.

3. The method of claim 1, wherein the upper punch and the lower punch form the mould cavity therebetween without a surrounding die.

4. The method of claim 1, wherein the upper ram and lower ram perform a single stroke at a velocity against the upper impact body integrated with or pressed against the upper punch, and against the lower impact body integrated with or pressed against the lower punch, respectively, and the downwards movable masses obtain said downwardly directed velocity and the upwards movable masses obtain said upwardly directed velocity.

5. The method of claim 2, wherein the upper ram and the lower ram are integrated with the upper punch and lower punch, respectively, the punches extend into the die, and the accelerations of the rams during the stroke take place completely while the surfaces of the punches that face the working material are within the region of the through hole of the die.

6. The method of claim 2, wherein a distance between the upper ram and the upper punch or an impact member that is integrated with or contacts the upper punch, and a distance between the lower ram and the lower punch or an impact member that is integrated with or contacts the lower punch, are adjusted to preset distances, after the upper punch and the lower punch have been brought to contact the working material in the mould cavity, said preset distances defining the lengths of the ram travels during the stroke.

7. The method of claim 6, wherein said upper impact member comprises the upper impact body and said lower impact member comprises the lower impact body, and wherein the upper impact body and the lower impact body are provided in an upper hydraulic impact body cylinder and in a lower hydraulic impact body cylinder, respectively, said impact body cylinders each having an upper and lower hydraulic cylinder containing hydraulic fluid, said hydraulic fluid during an initial pressing of the upper punch and of the lower punch against the working material in the mould cavity, exert a force on the impact bodies, said force being transferred via the upper punch and the lower punch as a pressure exerted on the working material in the mould cavity.

8. The method of claim 2, wherein the lower impact body abuts a lower punch holder prior to the stroke and the lower punch is fastened in the lower punch holder.

9. The method of claim 6, wherein the stroke lengths are set by means of hydraulic fitting devices that carry the upper and lower impact units, said hydraulic lifting devices also functioning as carrying members in a stand.

10. An impact machine for forming a body of a formable working material through impact action in a forming operation, the machine comprising:

a machine stand;

an upper impact unit with an upper ram;

a lower impact unit with a lower ram; and a central unit that is essentially stationary during the forming operation, the central unit including a mould tool between the upper impact unit and the lower impact unit, the mould tool comprising a die having a through hole that together with an upper punch and a lower punch form a mould cavity for the working material, the upper and lower impact units being controllably raised and lowered by elevator devices relative to the central unit for setting of predetermined stroke lengths of the upper ram and of the lower ram, respectively before the forming operation, and said elevator devices comprising hydraulically working members having at least two upper hydraulic lifting cylinders and auxiliary, vertical piston rods that are included in an upper stand unit and carry an upper carrier for the upper impact unit, and at least two lower, hydraulic lifting cylinders and auxiliary vertical, lower impact rods, which are included in a lower stand unit and carry a lower carrier for the lower impact unit.

11. The machine of claim 10, wherein:

the upper impact unit comprises an upper impact body, the lower impact unit comprises a lower impact body, the upper punch and the lower punch are provided to be brought to contact the working material in the mould cavity in the die prior to the forming operation, the upper impact body and the lower impact body are provided to be brought into direct or indirect mechanical contact with the upper punch and with the lower punch, respectively, at the latest in functional positions of the impact bodies before the forming operation, stroke lengths of the rams correspond to a distance of the upper ram to the upper impact body in a functional position of the upper impact body and a distance from the lower ram to the lower impact body in a functional position of the lower impact body, respectively.

12. An impact machine for forming a body of formable working material through impact action in a forming operation, the machine comprising:

a machine stand;

an upper impact unit with an upper ram;

an upper punch;

a lower impact unit with a lower ram;

a lower punch; and a mould cavity for the working material formed between the punches when the punches are brought towards one another, a stroke length of the upper ram being such that the upper ram is accelerated by motion members of the ram to a velocity such that upper parts that are movable during the forming operation and that include at least the upper ram and the upper punch obtain a first predetermined velocity, the upper parts having an upper part mass a stroke length of the lower ram being such that the lower ram is accelerated by motion members of the ram to a velocity such that lower parts that are movable during the forming operation and that include at least the lower ram and the lower punch obtain a second predetermined velocity, the lower parts having a lower part mass, the upper and lower part masses and the first and second predetermined velocities being such that the momentum of each of the downwards movable masses and the upwards movable masses become essentially equally large such that the following condition applies:

$$m_1 \times v_1 \cong m_2 \times v_2$$

where $m_1$ is the total mass of the downwards movable masses at impact and $m_2$ is the total mass of the upwards movable masses at impact, wherein the kinetic energies of the movable masses, defined as $(m_1 v_1^2)/2$ and $(m_2 v_2^2)/2$, are substantially transferred to the working material in the mould cavity and are of a magnitude such that the working material is plasticized and flows out and fills all parts of the mould cavity when the punches are maximally brought together for the formation of said body with desired shape, and wherein the rams are not integrated with the punches.

13. The machine of claim 12, wherein an upper impact body is provided between the upper ram and the upper punch and a lower impact body is provided between the lower ram and the lower punch.

14. The machine of claim 12, further comprising a die that, in combination with the punches defines the mould cavity, wherein the upper punch and the lower punch are partly inserted into the die prior to impact, the punches are integrated with the upper ram and with the lower ram, respectively, and the total stroke length of the rams is shorter than the length of a through hole of the die.

15. The machine of claim 10, wherein the upper impact body is provided in an upper, hydraulic impact body cylinder that is fixedly connected to said upper carrier, and the lower impact body is provided in a lower, hydraulic impact body cylinder that is fixedly united with the lower carrier.

16. An impact machine for forming a body of a formable working material through impact action in a forming operation, the machine comprising:

a machine stand;

an upper impact unit with an upper ram;

a lower impact unit with a lower ram; and a central unit that is essentially stationary during the forming operation, the central unit including a mould tool between the upper impact unit and the lower impact unit, the mould tool comprising a die having a through hole that together with an upper punch and a lower punch form a mould cavity for the working material, the upper and lower impact units being controllably raised and lowered by elevator devices relative to the central unit for setting of predetermined stroke lengths of the upper ram and of the lower ram, respectively before the forming operation, the two punches are tubular, a mandrel extends up into the mould cavity through the lower punch, and the mandrel is essentially stationary during the forming operation.

17. The impact machine of claim 16, wherein:

the lower punch is fastened in a lower punch holder, the lower punch holder is vertically movable in a punch holder guide that is stationary, and the mandrel is exchangeably mounted in the punch holder guide.

18. The machine of claim 16, wherein the mould cavity has cylindrical geometry.

19. The machine of claim 17, wherein the lower punch holder is dividable in a vertical center plane.

* * * * *

UNITED STATES PATENT AND TRADEMARK OFFICE

CERTIFICATE OF CORRECTION

PATENT NO. : 6,698,267 B1
DATED : March 2, 2004
INVENTOR(S) : H. Olsson

It is certified that error appears in the above-identified patent and that said Letters Patent is hereby corrected as shown below:

Title page,
Item [22], PCT Filed:, "April 26, 2000" should be -- April 26, 2001 --

Signed and Sealed this

First Day of June, 2004

JON W. DUDAS
*Acting Director of the United States Patent and Trademark Office*